US011846106B2

(12) United States Patent
Kontosic

(10) Patent No.: US 11,846,106 B2
(45) Date of Patent: Dec. 19, 2023

(54) METHOD FOR ARRANGING A FLASH COVING PROFILE IN THE TRANSITION BETWEEN A FLOOR AND A WALL AND A COMBINATION OF A FLASH COVING PROFILE AND AN END ELEMENT

(71) Applicant: Forbo Flooring B.V., Assendelft (NL)

(72) Inventor: Johnny Kontosic, Caledon (CA)

(73) Assignee: FORBO FLOORING B.V., Assendelft (NL)

( * ) Notice: Subject to any disclaimer, the term of this patent is extended or adjusted under 35 U.S.C. 154(b) by 90 days.

(21) Appl. No.: 17/332,278

(22) Filed: May 27, 2021

(65) Prior Publication Data

US 2022/0381044 A1 Dec. 1, 2022

(51) Int. Cl.
*E04F 19/04* (2006.01)

(52) U.S. Cl.
CPC ..... *E04F 19/0477* (2013.01)

(58) Field of Classification Search
CPC ... E04F 19/04; E04F 19/0477; E04F 19/0486; E04F 2019/0413; E04F 2019/0454
See application file for complete search history.

(56) References Cited

U.S. PATENT DOCUMENTS 1,555,392 A * 9/1925 Tracy ..... E04F 19/04 52/287.1
2,069,289 A * 2/1937 Swendsen ..... E04F 19/04 52/717.06
2,114,044 A * 4/1938 Bonnell ..... E04F 19/064 52/277
2,307,338 A * 1/1943 Sluyter ..... E04F 19/0495 52/288.1
2,994,905 A * 8/1961 Franker, Jr. ..... E04F 19/0495 52/273
3,192,576 A * 7/1965 Wieting ..... E04F 19/0495 52/287.1
3,475,871 A * 11/1969 Vincent ..... E04F 19/04 52/287.1
3,549,471 A * 12/1970 Denton ..... E04F 15/18 52/287.1

(Continued)

FOREIGN PATENT DOCUMENTS

CA 2137609 C * 6/2010 ..... E04F 19/045
DE 29823036 U1 * 1/2000 ..... E04F 19/0495

(Continued)

*Primary Examiner* — James M Ference
(74) *Attorney, Agent, or Firm* — Browdy and Neimark, PLLC

(57) ABSTRACT

There is provided a method for arranging a flash coving profile in the transition between a floor and a wall, wherein the method includes providing an end element, the end element including a transition part having an outer surface, an upper edge and a first side, and a wall fixator part, fixing the wall fixator part to the wall, placing the upper edge of the transition part in a holding space of the wall fixator part and fixing the transition part to the floor and/or the wall, and placing the first edge of the flash coving profile at its first end in the holding space such that the first side of the transition part is placed against the first end of the metal sheet, and the outer surface of the transition part lies substantially flush with the flooring of the flash coving profile.

17 Claims, 6 Drawing Sheets

(56) References Cited

U.S. PATENT DOCUMENTS 3,739,423 A * 6/1973 Denton ..... E04F 15/10 16/10
4,706,427 A * 11/1987 Zeilinger ..... A47K 3/001 52/287.1
4,845,910 A * 7/1989 Hanson ..... E04F 19/04 52/287.1
5,010,703 A * 4/1991 Pearlman ..... E04F 19/04 52/287.1
5,212,923 A * 5/1993 Pelosi ..... A47G 27/0456 52/287.1
5,444,954 A * 8/1995 Anderson ..... E04F 19/02 52/211
5,598,681 A * 2/1997 DiGianni ..... H02G 3/0425 52/718.04
6,122,872 A * 9/2000 Sauter ..... H02G 3/0425 52/287.1
6,401,418 B1 * 6/2002 Senn ..... E04F 19/04 52/287.1
7,703,249 B2 * 4/2010 Rachak ..... E04F 19/04 52/60
8,375,663 B2 * 2/2013 Johnston ..... E04B 2/7422 52/287.1
8,572,915 B2 * 11/2013 Meahl ..... E04F 19/04 52/287.1
10,145,125 B2 * 12/2018 O'Brien ..... E04F 19/0477
10,487,518 B2 * 11/2019 Anzalone, Jr. ..... E04F 19/061
10,787,823 B2 * 9/2020 Lavallie ..... E04F 15/06
2004/0187396 A1 * 9/2004 Higgins ..... E04F 19/045 52/302.6
2006/0185295 A1 * 8/2006 Gardner ..... A47G 27/0456 52/384
2006/0277777 A1 * 12/2006 Mossot ..... E04F 19/0495 33/527
2008/0092470 A1 * 4/2008 Jackson ..... E04F 19/0495 52/288.1
2008/0245006 A1 * 10/2008 Rachak ..... E04F 19/04 52/287.1
2012/0085048 A1 * 4/2012 Higgins ..... E04F 19/0495 52/287.1
2017/0183879 A1 * 6/2017 Rossi ..... E04F 19/061
2018/0371766 A1 * 12/2018 Anzalone, Jr. ..... E04F 19/0486
2020/0141133 A1 * 5/2020 Lavallie ..... E04F 19/061
2022/0381044 A1 * 12/2022 Kontosic ..... E04F 19/0477

FOREIGN PATENT DOCUMENTS

DE 20201558 U1 * 6/2002 ..... E04F 19/04
GB 2476170 A * 6/2011 ..... E04F 19/045
WO WO-03105637 A1 * 12/2003 ..... A47G 27/0456
WO WO-2010139990 A1 * 12/2010 ..... E04F 19/045
WO WO-2012150447 A1 * 11/2012 ..... E04F 19/045

* cited by examiner

METHOD FOR ARRANGING A FLASH COVING PROFILE IN THE TRANSITION BETWEEN A FLOOR AND A WALL AND A COMBINATION OF A FLASH COVING PROFILE AND AN END ELEMENT

BACKGROUND OF THE INVENTION

Field of the Invention

The invention relates to a method for arranging a flash coving profile in the transition between a floor and a wall.

Description of Related Art

For different applications, it is common to apply a flexible flooring such as resilient flooring to a subfloor. Typically, it is not desirable to use the same flooring to cover the entire adjacent wall, but still it is beneficial to create a smooth transition between the subfloor and the wall which is less likely to collect dust. To this purpose, it is known to flash cove the flooring up to the wall.

Traditionally, when flash coving, an upside-down U-shaped cove cap is fixed to the wall (e.g. with adhesive tape or contact cement) and a flexible vinyl or metal fillet-shaped cove former strip is arranged between the cove cap and the subfloor at the junction of the floor and the wall, after which a resilient layer is formed towards to the cove former and fixed to the cove cap. The main flooring may be installed either before or after flash coving. Both procedures have the disadvantage of being complex, requiring specialized installation skills. Furthermore, the cove former strip or the flooring may be damaged by pressing the flooring to hard against the cove former strip in the corner.

In other solutions, the fillet-shaped cove former strip is adhered to the back of the flooring and by that integrated with the flooring or, as an alternative, formed by reinforcing the backing of the flooring, thereby decreasing the number of steps necessary for installation. However, in such cases, the fixed position of the pre-installed cove cap limits the flexibility in fitting the cove former strip and furthermore increases the risk of misalignment of the cove former strip between the pre-installed cove cap and the pre-installed main flooring.

U.S. Pat. No. 2,994,905 A discloses another method for installing a flash cove. In this method, the fillet-shaped cove former and the cove cap are integrated in a single unit, to which the flooring layer is applied afterwards. The production of this flash coving profile is relatively costly due to the complex shape of the profile.

U.S. Pat. No. 10,787,823, the contents of which are hereby incorporated in its entirety, discloses a method for producing a flash coving profile. The method comprises providing an elongate metal sheet with a first longitudinal edge and a second edge opposing, and preferably parallel to, the first edge. A flexible and preferably resilient flooring is adhered to a first face of the metal sheet, the flooring extending from the first edge to at least the second edge; then a cove is bent into the metal sheet with the flooring adhered to it along a bend line which is parallel to and spaced apart from the first edge and on the side to which the flooring is adhered. This method provide a flash coving profile that can be produced and applied efficiently.

It is an object of the invention to further improve and facilitate the application of flash coving profiles in the transition between a floor and a wall.

SUMMARY OF THE INVENTION

This object is achieved with a method for arranging a flash coving profile in the transition between a floor and a wall, comprising the steps of:

- providing a flash coving profile, the flash coving profile comprising:
  - an elongate metal sheet with a first longitudinal edge and a second edge opposing the first edge, wherein the first edge and the second edge of the metal sheet extend from a first end to a second end of the metal sheet;
  - a flexible flooring adhered to a first face of the metal sheet, the flooring extending from the first edge to at least the second edge and from the first end to the second end; and
  - a cove bent into the metal sheet with the flooring adhered to it along a bend line which is parallel to and spaced apart from the first edge and on the side to which the flooring is adhered, the flash coving profile having a first section extending between the first edge and the cove and has a second section extending between the second edge and the cove;
- adhering the first section of the flash coving profile to the wall;
- adhering the second section of the flash coving profile to the floor; and
- providing a further flexible and preferably resilient flooring to the floor abutting the flooring of the flash coving profile, wherein the method further comprises:

- providing an end element, the end element comprising
  - a transition part having an outer surface, an upper edge and a first side, the first side to be placed against the first end of the metal sheet, and
  - a wall fixator part, wherein the wall fixator part comprises a holding space to hold the upper edge of the transition part and the first edge of the metal sheet at its first end,
- fixing the wall fixator part to the wall,
- placing the upper edge of the transition part in the holding space of the wall fixator part and fixing the transition part to the floor and/or the wall, and
- placing the first edge of the flash coving profile at its first end in the holding space such that the first side of the transition part is placed against the first end of the metal sheet.

The provision of end elements on the first end and/or the second end of the flash coving profile gives a more aesthetic appearance of the floor covering. The end elements also provide for a more convenient, efficient and reliable mounting of the flash cover elements on the transition between wall and floor, i.e. on the floor line. The presence of end elements may also make it more difficult to pull the flash coving profile from its mounted position. This may for example be beneficial in locations where people may feel the need to pull the flash coving profile from its mounted position.

In an embodiment of the method of the invention, the outer surface of the transition part lies substantially flush with the flooring of the flash coving profile after mounting of the end element and the flash coving profile. By providing a flush transition between the transition part and the flooring of the flash coving profile an attractive appearance is obtained. Further, the penetration of tools between the end element and the flash coving profile to disengage the flash coving profile from its mounted position is made more difficult.

In an embodiment of the method of the invention, the steps of fixing the wall fixator part to the wall and fixing the transition part to the floor and/or the wall are carried out before adhering the first section of the flash coving profile to the wall and the second section of the flash coving profile to the floor. By mounting the end elements before the flash coving profiles, the screws with which the wall fixator part and/or transition part may be fixed to the wall and/or floor, can be covered by the flash coving profile. The end elements also help to place the flash coving profile more efficiently in the intended position.

In an embodiment of the method of the invention, the end element is a left end cap element, a right end cap element, an inner corner element or an outer corner element. Dependent on the location of the end element, the end element may have different functions, such as bridging an inner corner or an outer corner of a wall, or creating an end of the one or more flash coving profiles at either the left end or the right end thereof.

In an embodiment of the method of the invention, the wall fixator part is made of metal, such as aluminum or steel, and the transition part is made of a polymer material or a resin material, such as thermoplastic polymers and/or bio based fiber reinforced resins. The metal of the wall fixator part provides a good strength to hold the flash coving profile and the transition part. The polymer material or the resin material may be used to provide a suitable shape to the transition part, for example to create a smooth transition between the outer surface of the flash coving profile and the transition part. In other embodiments, the wall fixator part and/or the transition part may be made of other suitable materials such as metal, a polymer material or a resin material.

In an embodiment of the method of the invention, the wall fixator part comprises one or more fixation holes wherein fixing the wall fixator part to the wall comprises screwing or gluing using the one or more fixation holes.

In an embodiment of the method of the invention, the transition part comprises one or more fixation holes, wherein fixing the transition part to the floor and/or the wall comprises screwing or gluing using the one or more fixation holes.

In an embodiment, the method comprises the step of covering the fixation holes of the wall fixator part by the flash coving profile, transition part and/or further flooring and the step of covering the fixation holes of the transition part by the flash coving profile and/or further flooring.

In an embodiment of the method of the invention, wherein the method comprises:

- providing a second end element, the second end element comprising
  - a transition part having an outer surface, an upper edge and a first side, the first side to be placed against the second end of the metal sheet, and
  - a wall fixator part, wherein the wall fixator part comprises a holding space to hold the upper edge of the transition part and the first edge of the metal sheet at its second end,
- fixing the wall fixator part of the second end element to the wall,
- placing the upper edge of the transition part of the second end element in the holding space of the wall fixator part and fixing the transition part to the floor and/or the wall, and
- placing the first edge of the flash coving profile at its second end in the holding space such that the first side of the transition part is placed against the second end of the metal sheet, and the outer surface of the transition part lies substantially flush with the flooring of the flash coving profile. Since the flash coving profile has two ends, an end element could be arranged at either end of the flash coving profile. It is also possible that one of the ends is directly placed against a wall or door frame. One end or both ends of the flash coving In an embodiment of the method for arranging a flash coving profile, the method further comprises the step of welding the flooring of the flash coving profile to the further flooring. The provision of a weld between the flooring of the flash coving profile and the further flooring creates a watertight and visually seamless connection between these parts. Suitable welding techniques that can be used for resilient flooring sheet may for example comprise fusing or melting a thermoformable rod in the seam between two sheets.

The invention further provides a combination of a flash coving profile and an end element, the flash coving profile comprising:

- an elongate metal sheet with a first longitudinal edge and a second edge opposing the first edge, wherein the first edge and the second edge of the metal sheet extend from a first end to a second end of the metal sheet;
- a flexible flooring adhered to a first face of the metal sheet, the flooring extending from the first edge to at least the second edge and from the first end to the second end; and
- a cove bent into the metal sheet with the flooring adhered to it along a bend line which is parallel to and spaced apart from the first edge and on the side to which the flooring is adhered, and the end element comprising:

- a transition part having an outer surface, an upper edge and a first side, the first side to be placed against the first end or the second end of the metal sheet, and
- a wall fixator part to be fixated to a wall, wherein the wall fixator part comprises a holding space to hold the upper edge of the transition part and the first edge of the metal sheet at its first end. In practice multiple flash coving profiles and end elements of one or more types, such as a left end cap element, a right end cap element, an inner corner element and an outer corner element, may be provided to arrange a flash coving profile along the floor line of a space.

In an embodiment, the combination comprises that, when the first side is placed against the first end or the second end of the metal sheet, the outer surface of the transition part lies substantially flush with the flooring of the flash coving profile.

In an embodiment of the combination, the wall fixator part is made of metal, such as aluminum or steel, and the transition part is made of a polymer material or a resin material, such as thermoplastic polymers and/or bio based fiber reinforced resins. The metal of the wall fixator part provides a good strength to hold the flash coving profile and the transition part. The polymer material or the resin material may be used to provide a suitable shape to the transition part, for example to create a smooth transition between the outer surface of the flash coving profile and the transition part. In other embodiments, the wall fixator part and/or the transition part may be made of other suitable materials such as metal, a polymer material or a resin material.

In an embodiment of the combination, wherein the wall fixator part comprises one or more fixation holes to fix the wall fixator part to a wall. Correspondingly, in an embodiment of the combination, wherein the transition part comprises one or more fixation holes to fix the transition part to a floor and/or a wall. The fixation holes are for example a number of openings to receive screw or similar fixation elements the fixation openings may also be used when fixation is carried out by gluing. The fixation holes may be arranged at locations that will be covered by the flash coving profile or flooring so that the fixation holes are no longer accessible after mounting of the flash coving profiles. The fixation holes may for example be arranged in plate elements that will be covered by the flash coving profiles. The fixation holes of the wall fixator parts may also at least partly be covered by the associated transition part.

In an embodiment of the combination, the transition part of the end element comprises a second side, the second side to be placed against the second end of a metal sheet of a second flash coving profile, wherein the holding space is arranged to hold the upper edge of the transition part, the first edge of the metal sheet of the first flash coving profile at its first end and the first edge of the metal sheet of the second flash coving profile at its second end. An end element may be arranged between two flash coving profiles, wherein the adjacent ends of the flash coving profiles are placed against the transition part of the end element, and wherein the upper edges of the respective ends are received in the holding space of the wall fixator part. Such two sided end element may for example be an inner corner element or an outer corner element.

In an embodiment of the combination, the combination comprises a second end element, the second end element comprising:

- a transition part having an outer surface, an upper edge and a first side, the first side to be placed against the first end or the second end of the metal sheet, and
- a wall fixator part to be fixated to a wall, wherein the wall fixator part comprises a holding space to hold the upper edge of the transition part and the first edge of the metal sheet at its second end.

In the flash coving profile of the invention, the fillet-shaped cove former (made of a metal sheet) may be provided with a layer of flexible and preferably resilient flooring to a first face of the metal sheet after which this combination is bent into a cove before adhering the flash coving profile to the wall. This increases the ease of production of the flash coving profile, which is substantially L-shaped and has a first section or leg to be adhered to a wall and a second section or leg to be adhered to a subfloor. The cove is preferably bent into the metal sheet by roller forming.

The bend line may be on the side to which the flooring is adhered, which causes the first and second edge to lay closer to each other after bending when seen from the side of the profile to which the flooring is adhered.

The flooring will typically cover the entire first face, while the opposing second face of the metal sheet is free from covering or other material, allowing the metal sheet to be adhered directly to a subfloor and wall. The metal sheet is typically an aluminum sheet. Typically the length of the first edge ranges from 2.4 to 3.7 meters, while the width or distance between the first and second edge is typically approximately 200 millimeters. Typical examples of floorings are vinyl, linoleum, nylon 6,6 (preferably embodied as in the product Flotex, which is sold by the applicant) or rubber.

The flooring may extend beyond the second edge, preferably over a width of 50 to 150 mm perpendicular to the first edge. In this way, it is easier to connect the flooring adhered to the coving profile to a further (main) flooring which covers the floor and which is typically of the same material as the flooring adhered to the metal profile. In installation of the coving profile in the corner between a wall and a floor, the additional amount of flooring which protrudes from the second edge can be arranged to slope towards and abut against the main flooring, in order to accommodate for height differences between the flooring of the flash coving profile and the further flooring. This protruding part is preferably fixed in this position upon installation by merely creating a sloping layer of leveling adhesive, therefore eliminating the need for a leveler strip.

A protrusion with a width of less than 50 mm will be too short for most purposes to bridge height differences between the coving profile and the further flooring, whereas a protrusion of more than 150 mm will make the flash coving profile unnecessarily large for most purposes.

The method for producing a flash coving profile may comprise the step of arranging a self-adhesive strip on the second face of the metal sheet along the first edge. The arrangement of a self-adhesive strip, preferably provided with a removable protective foil in order to prevent preliminary adhesion, allows the flash coving profile produced to be fixed fast, without requiring screws or nails. Typically the flash coving profile produced is, when it is applied in the corner between a wall and a subfloor, in addition to the self-adhesive strip, adhered with a main adhesive layer which hardens out overtime. The main adhesive layer is typically applied to the wall and floor. During the period required for hardening of the main adhesive, the self-adhesive strip will avoid the flash coving profile from releasing.

The method to produce the flash floor covering may comprise the step of folding a zone of the elongate metal sheet adjacent to the first edge into a cove cap having a substantially U-shaped cross-section.

Although it is possible to provide a separate cove cap which is connected to the flash coving profile, it is preferred to fold a zone of the elongate metal sheet adjacent to the first edge into a cove cap, as this decreases the number of steps for obtaining a cove. In this embodiment, the metal sheet thus comprises a zone to be folded into the cove cap, which extends beyond the first edge. Folding can be carried out by roller folding or angle bending. Extrusion is however an alternative way of obtaining a cove cap which should also be considered part of the scope of the invention.

The method for producing a flash coving profile may further comprise that the zone is folded into a cove cap before adhering the flooring to the sheet. Folding the zone into a cove cap before adhesion of the flooring to the metal sheet avoids the unintentional creation of folds in the flooring near the cove cap which may occur while folding the zone into a cove cap, when the flooring would have been already adhered.

The method to produce the flash floor covering may comprise the steps of finishing the cove cap, comprising steps such as anodizing, lacquering or providing a cover layer. In order to match aesthetical demands, the cove cap may be finished. Typical ways of finishing are anodization, lacquering or covering the cove cap with a cover layer with a decorative print. All of these steps may be performed before arranging the flash coving in the corner between a floor and wall.

BRIEF DESCRIPTION OF THE DRAWINGS

These and other aspects of the invention are further elucidated in the following drawings.

DESCRIPTION OF THE INVENTION

Figure 1A:
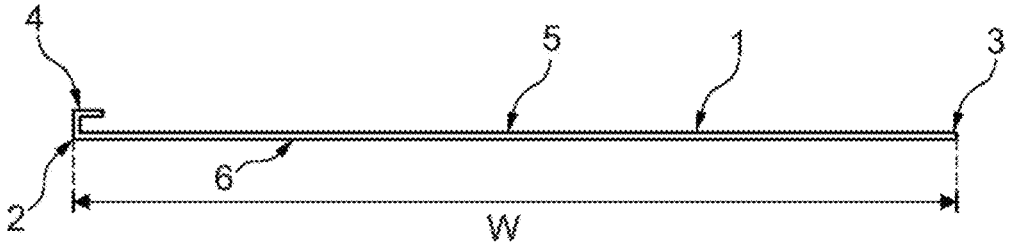
FIGS. 1A to 1C shows the steps of producing a flash coving profile according to the invention.
Figure 1B:
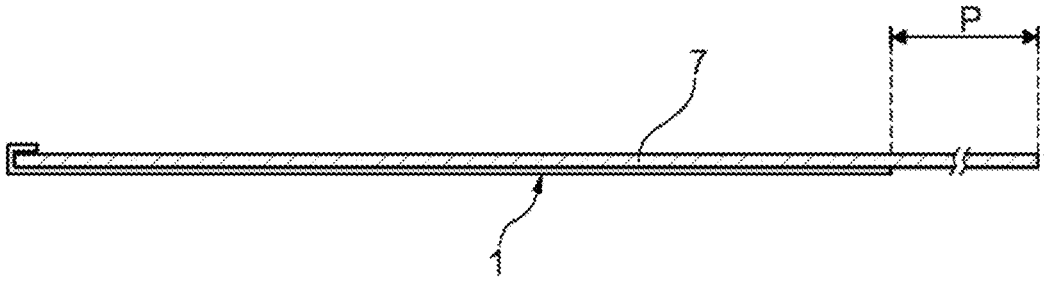
Figure 1C:
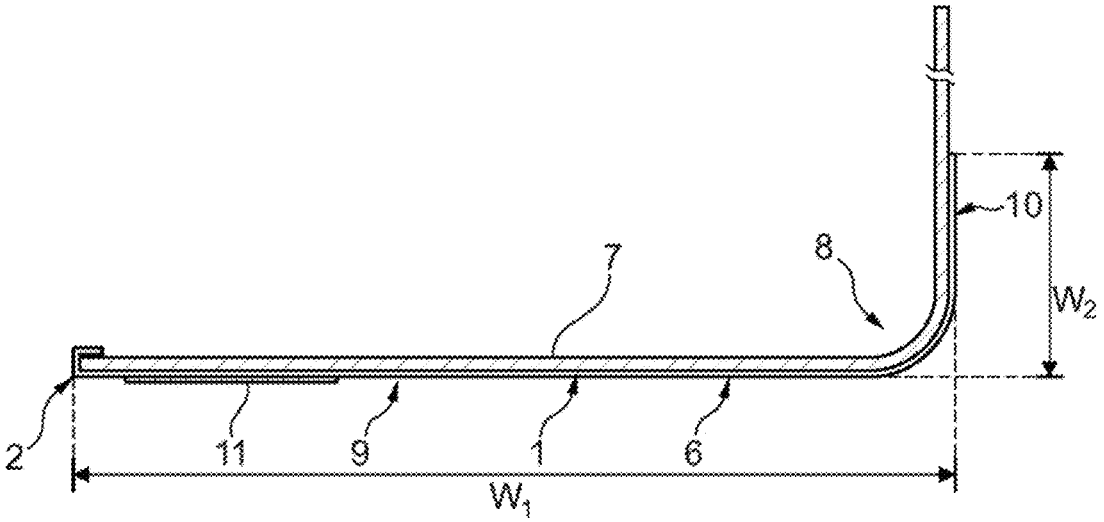
Figure 2:
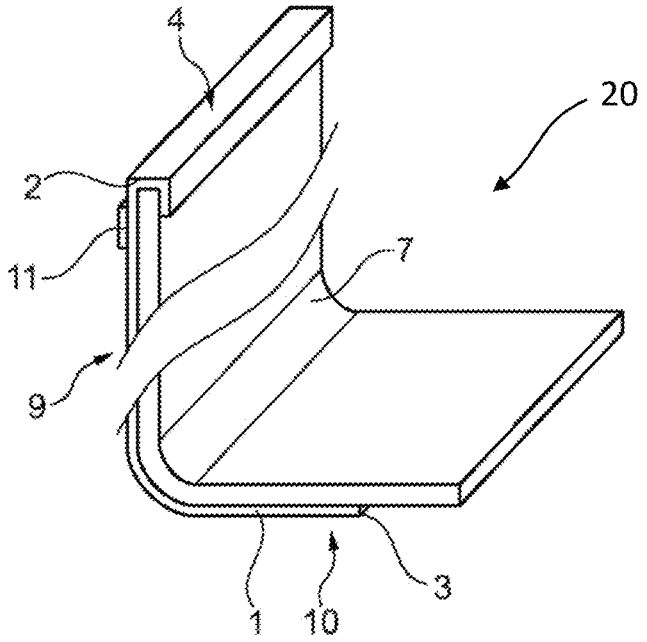
FIG. 2 shows a perspective view of the obtained flash coving profile.

The invention relates to a method for forming a flash coving profile according to the invention is disclosed in FIG. 1. The method starts, as shown in FIG. 1A, with a metal sheet 1 with a first edge 2 and a second edge 3, with a width W of approximately 200 millimeters. The length of the sheet 1, which runs perpendicular to the plane of the drawing, is typically between 2.4 and 3.7 meters. A zone adjacent to the first edge 2 is folded into a U-shaped cove cap 4. The metal sheet has a first face 5 and an opposing second face 6. Then, a layer of flooring 7 is adhered to the first face 5 of the metal sheet 1, protruding from the second edge 3 to a width P of between 50 and 150 millimeters. After that, a cove 8 with a radius of 12 to 26 millimeter is bent into the metal sheet along a bend line parallel to the first edge 2 and second edge 3, to obtain an L-shaped coving profile which has a first section 9 extending from the first edge to the cove 8, to be adhered to a wall, and a second section 10 extending from the second edge 3 to the cove 8, to be adhered to a subfloor. The width $W_1$ is typically around four times larger than the width $W_2$. Also, a self-adhesive strip 11 is arranged on the second face 6 of the metal sheet 1 close to the first edge 2. The obtained flash coving profile 20 is also shown in FIG. 2.

Figure 3:
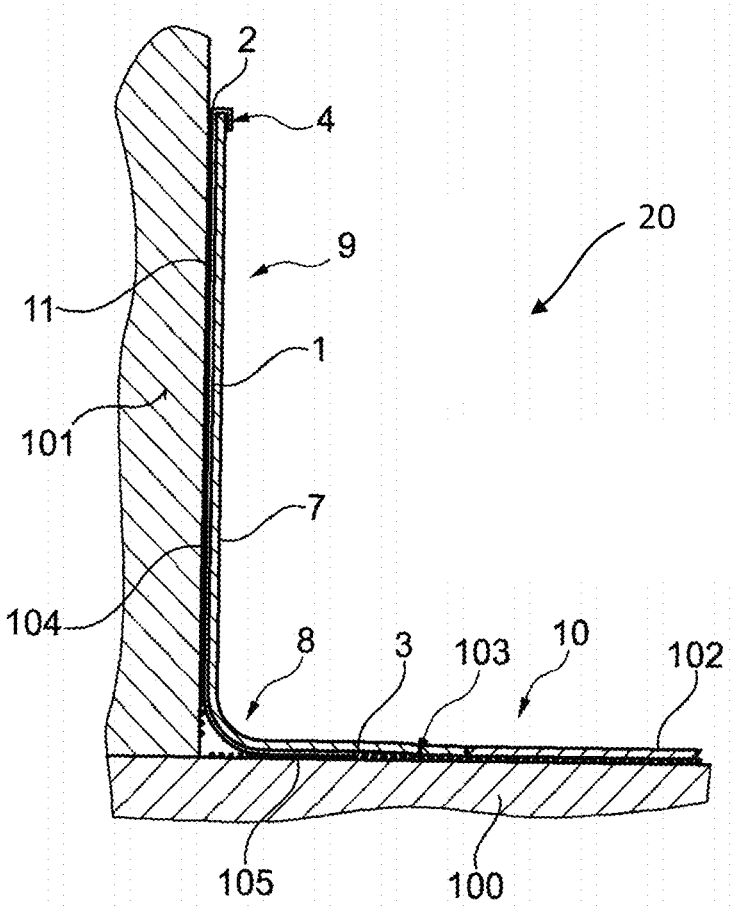
FIG. 3 shows a cross-sectional view of the flash coving profile installed on a floor line.

FIG. 3 shows the flash coving profile 20 installed in the corner between a subfloor 100 and a wall 101. The main flooring 102 abuts against the flooring layer 7 and is installed net fit or is welded to layer 7. The difference in thickness between the further flooring 102 and the flooring 7 which is arranged on the metal sheet 1 is accompanied for by a leveling adhesive layer 103 sloping towards the further flooring 102. It should be noted that the profile is, in addition to the self-adhesive strip 11, adhered to the floor 100 and wall 101 with layers of adhesive 104, 105 which are applied to the (sub)floor 100 and wall 101 before positioning the profile in the corner.

Figure 4:
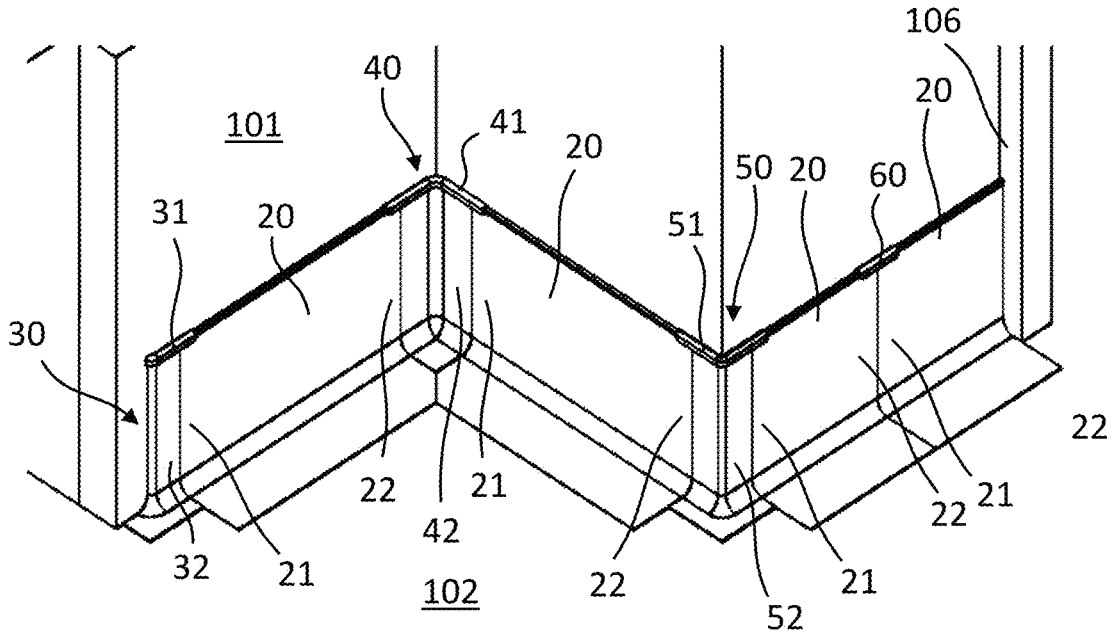
FIG. 4 shows a perspective view of a flash coving profile according to the invention installed on a floor line.

FIG. 4 shows a number of flash coving profiles 20 mounted on a transition between a wall 101 and a (sub)floor. On the sub(floor) further flooring 102 is arranged. The layers of flooring 7 on the flash coving profiles 20 provide a substantially continuous surface with the upper surface of the further flooring 102. Each flash coving profile 20 comprises a first end 21 and a second end 22, i.e. In the mounted position the flash coving profile extends in substantially horizontal direction between the first end 21 and the second end 22. The wall 101 comprises some corners and, at the left side, an open end, i.e. the flash coving profile does not end on a wall or a doorframe or similar. Different end elements are provided to create a proper transition of the first end 21 and/or second end 22 flash coving profile 20 to the wall 101 or a second flash coving profile 20. Such transition not only provides a neat finish of the flash coving profile, but also makes pulling the flash coving profile from the wall 101 more difficult.

To provide a proper end at the left open end of the wall 101, a left end cap element 30 is provided at the first end 21 of the most left flash coving profile 20. At the second end 22 of this flash coving profile 20, an inner corner element 40 is provided that provides a transition to the first end 21 of a second flash coving profile 20. The second end 22 of this second flash coving profile 20 is placed against an outer corner element 50 to provide a transition for the outer corner of the wall 101 to the first end 21 of a third flash coving profile 20. The second end 22 of this third flash coving profile 20 is directly placed against the first end 21 of a fourth flash coving profile 20, while a connection element 60 is provided to hold the second end 22 of the third flash coving profile 20 and the first end 21 of the fourth flash coving profile 20. The second end of the fourth flash coving profile 20 is directly placed against a door frame 106. No end element is needed to create a neat transition to the door frame 106.

The different end elements will now be described in more detail.

Figure 5A:
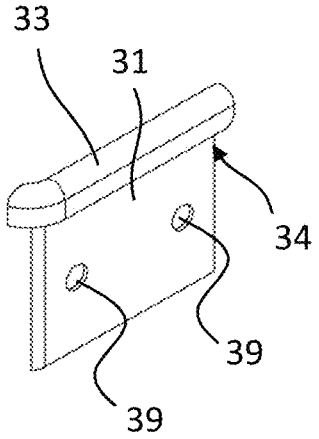
FIGS. 5A and 5B show a wall fixator part and a transition part of a left end cap element according to an embodiment of the invention.
Figure 5B:
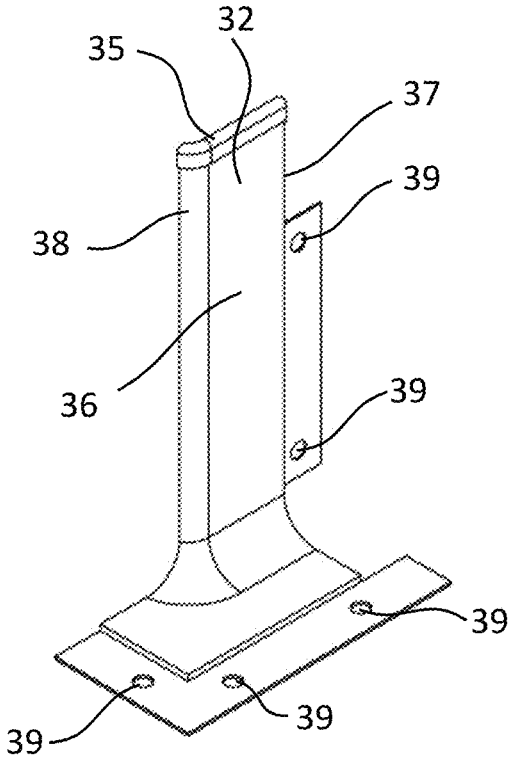

FIGS. 5A and 5B show a wall fixator part 31 and a transition part 32 of the left end cap element 30. The wall fixator part 31 is arranged to be fixated to the wall 101. The wall fixator part 31 comprises an upper wall 33, in this embodiment U-shaped, that defines a holding space 34 to hold the upper edge 35 of the transition part and the first edge 2 of the metal sheet 1 at its first end 21. The transition part 32 has an outer surface 36, an upper edge 35 and a first side 37. The first side 37 has a flat surface substantially perpendicular to the wall 101 on which the transition part 32 is mounted. In FIG. 4, the first side 37 is placed against the first end 21 of the metal sheet 1, such that the outer surface 36 of the transition part 32 lies substantially flush with the flooring 7 of the flash coving profile 20. The second side 38 of the transition part 32 opposite to the first side 37 is shaped to make smooth transition to the wall surface. Fixation holes 39 are provided to mount the wall fixator part 31 on the wall 101 and the transition part 32 on the (sub)floor 100 and wall 101. The fixation holes 39 are arranged on plate elements that are positioned to be covered by flooring during arrangement of the flooring. This flooring may be flooring layer 7 of the flash coving profile or additional flooring. It is also possible that the fixation holes of the wall fixator part 31 will at least partly be covered by the transition part 32.

Figure 6A:
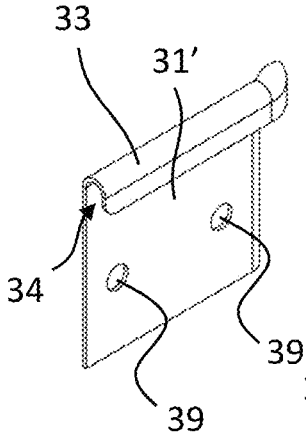
FIGS. 6A and 6B show a wall fixator part and a transition part of a right end cap element according to an embodiment of the invention.
Figure 6B:
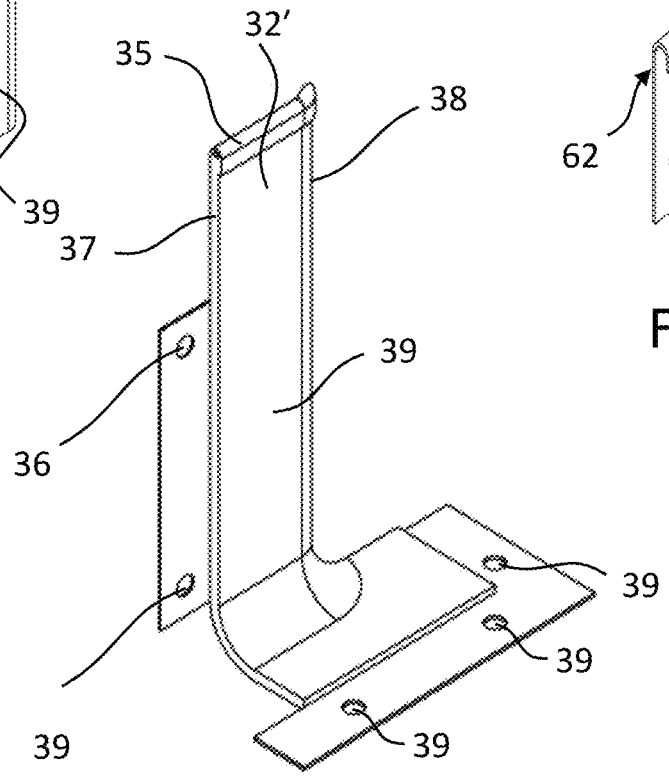

FIGS. 6A and 6B show a wall fixator part 31' and a transition part 32' of a right end cap element. The right end cap element 30 could be used to provide a final end element to a second end 22 of a flash coving profile 20. For example, the right end cap element could be arranged at the second end 22 of the fourth flash coving profile 20 of FIG. 4 if no door frame 106 would be present. Since the wall fixator part 31' and transition part 32' are constructed the same, but mirrored, as the wall fixator part 31 and the transition part 32 of the left end cap element 30, the same parts are indicated with the same reference numerals.

Figure 7A:
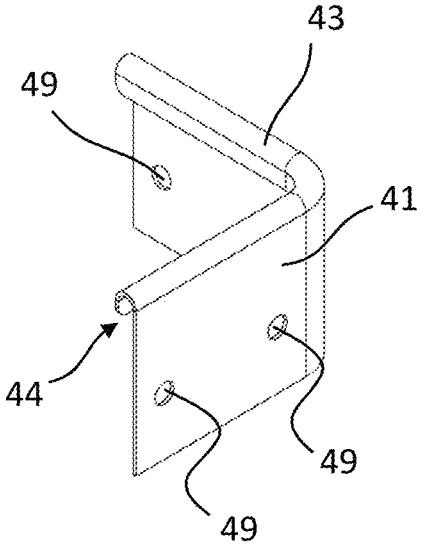
FIGS. 7A and 7B show a wall fixator part and a transition part of an inner corner element according to an embodiment of the invention.
Figure 7B:
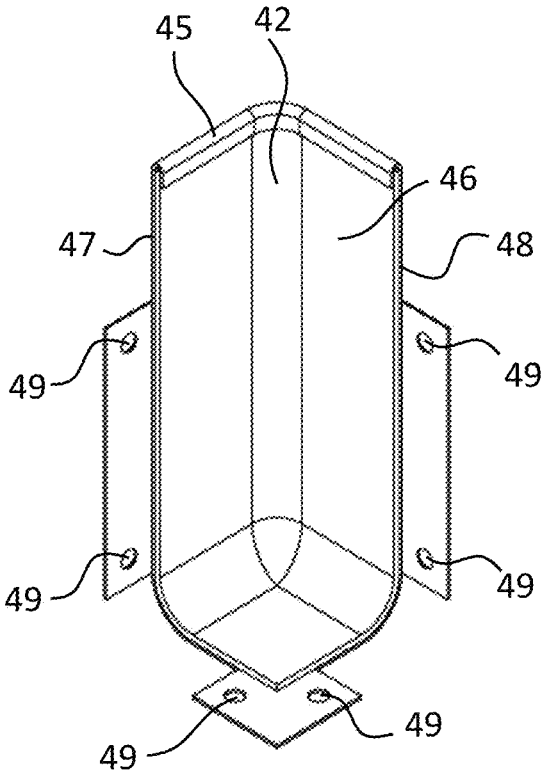

FIGS. 7A and 7B show a wall fixator part 41 and a transition part 42 of the inner corner element 40. The wall fixator part 41 and the transition part 42 are hooked to fit in the inner corner of the wall 101. The wall fixator part 41 comprises a U-shaped upper wall 42 following the hooked shape, that defines a holding space 44. The holding space 44 is constructed to receive the hooked upper edge 45 of the transition part 42 and to receive at one side of the upper edge 45 the first edge 2 of a flash coving profile 20 at its first end 21 and at the opposite side of the upper edge 45 the first edge 2 of another flash coving profile 20 sheet 1 at its second end 21.

The transition part 42 has an outer surface 46, an upper edge 45 a first side 47 and a second side 48. The first side 47 and the second side 48 each have a flat surface substantially perpendicular to the wall 101 on which the respective part of the transition part 42 is mounted. In FIG. 4, the first side 47 is placed against the second end 22 of the metal sheet 1 of the first flash coving profile 20, such that the outer surface 46 of the transition part 42 lies substantially flush with the flooring 7 of the first flash coving profile 20 and the second side 48 is placed against the first end 21 of the metal sheet 1 of the second flash coving profile 20, such that the outer surface 46 of the transition part 42 also lies substantially flush with the flooring 7 of the second flash coving profile 20. In the wall fixator part 41 and the transition part 42, fixation holes 49 to mount the wall fixator part 41 on the wall 101 and the transition part 42 on the (sub)floor 100 and wall 101 are provided. The fixation holes 49 are arranged on plate elements that are positioned to be covered by flooring or the transition part 42 during arrangement of the flooring. This flooring may be flooring layer 7 of the flash coving profile or additional flooring.

Figure 8A:
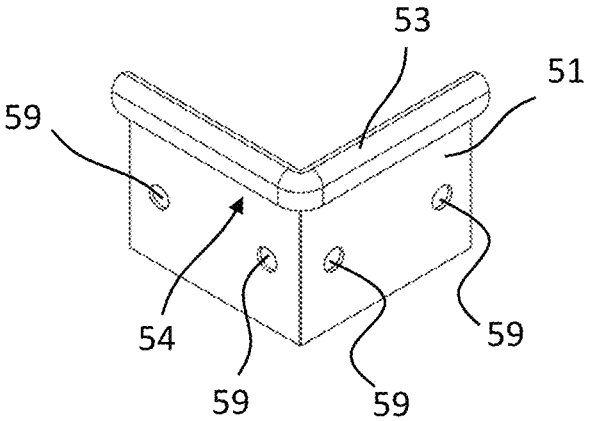
FIGS. 8A and 8B show a wall fixator part and a transition part of an outer corner element according to an embodiment of the invention.
Figure 8B:
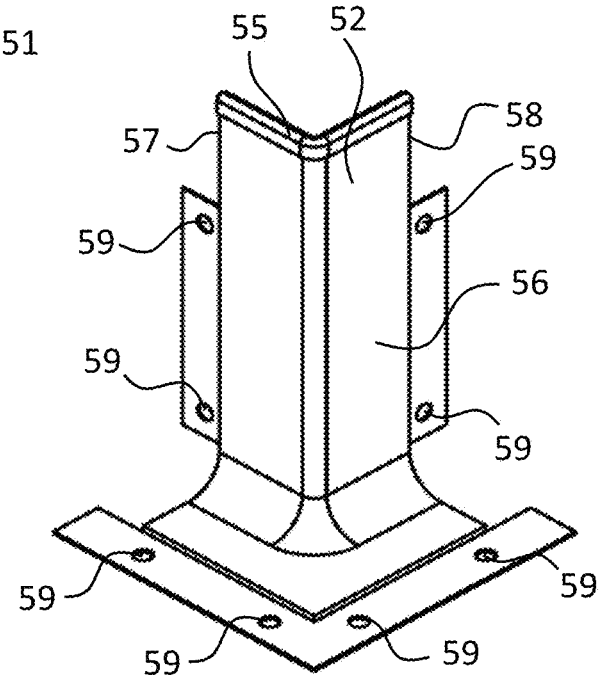

FIGS. 8A and 8B show a wall fixator part 51 and a transition part 52 of the outer corner element 50. The wall fixator part 51 and the transition part 52 are hooked to fit on the outer corner of the wall 101. The wall fixator part 51 comprises an upper wall 52 defines a holding space 54 to hold a hooked upper edge 55 of the transition part 52 and the first edge of two flash coving profiles 20 at opposite sides of the upper edge 55. The transition part 52 has an outer surface 56, the upper edge 55, a first side 57 and a second side 58, with similar functions as the corresponding parts of the inner corner element 40. The wall fixator part 51 and the transition part 52, comprise fixation holes 59 to mount the wall fixator part 41 on the wall 101 and the transition part 42 on the (sub)floor 100 and wall 101 are provided.

Figure 9:
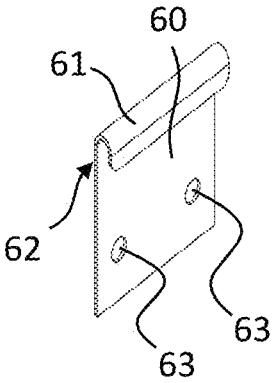
FIG. 9 shows a connection element according to an embodiment of the invention.

FIG. 9 shows a connection element 60 having an upper U-shaped wall 61 that defines a holding space 62 to hold the first edges 2 of two adjacent flash coving profiles 20, as shown in FIG. 4. The connection element 60 comprises fixation holes 63 to fix the connection element 60 to a wall 101. The fixation holes are arranged to be covered by the flash coving profiles 20 once the flash coving profiles are mounted in the connection element 60.

Figure 10A:
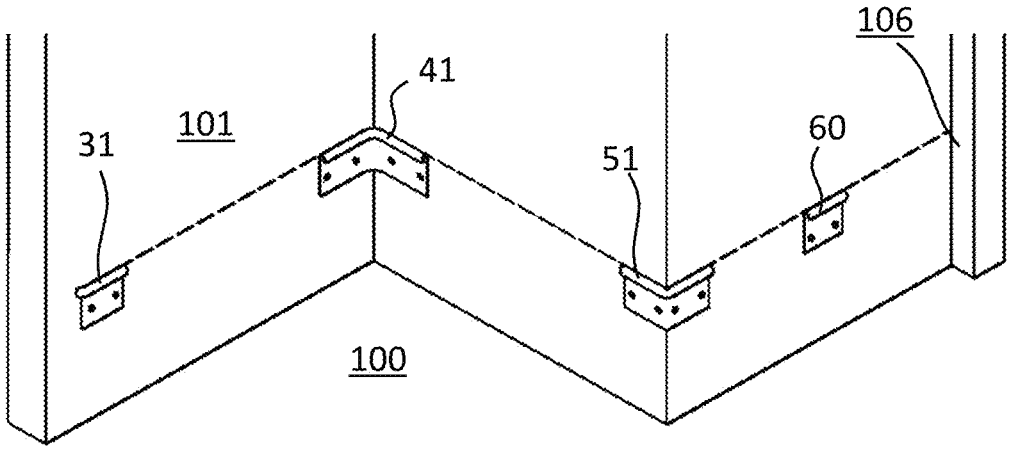
FIGS. 10A to 10C show different steps of arranging an embodiment of a floor covering in the transition between a wall and a floor.
Figure 10B:
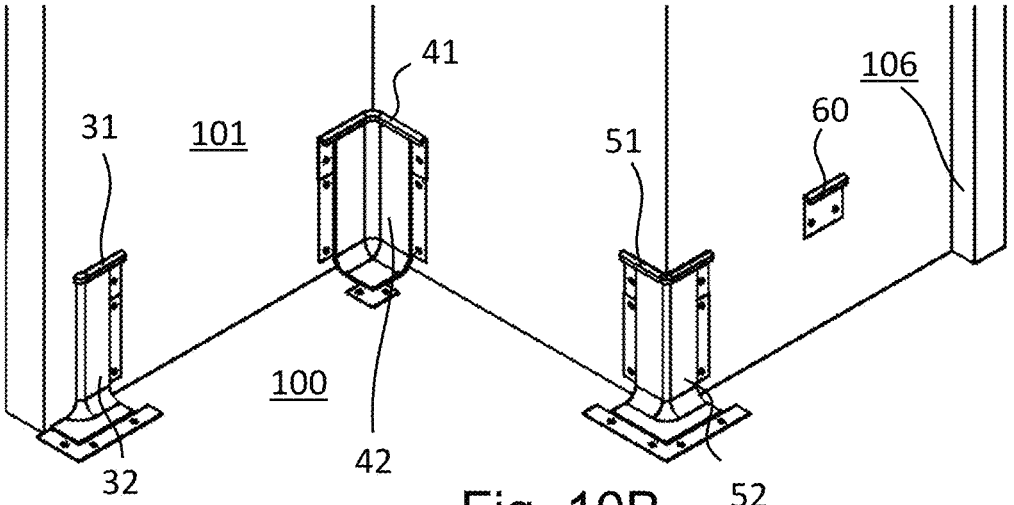
Figure 10C:
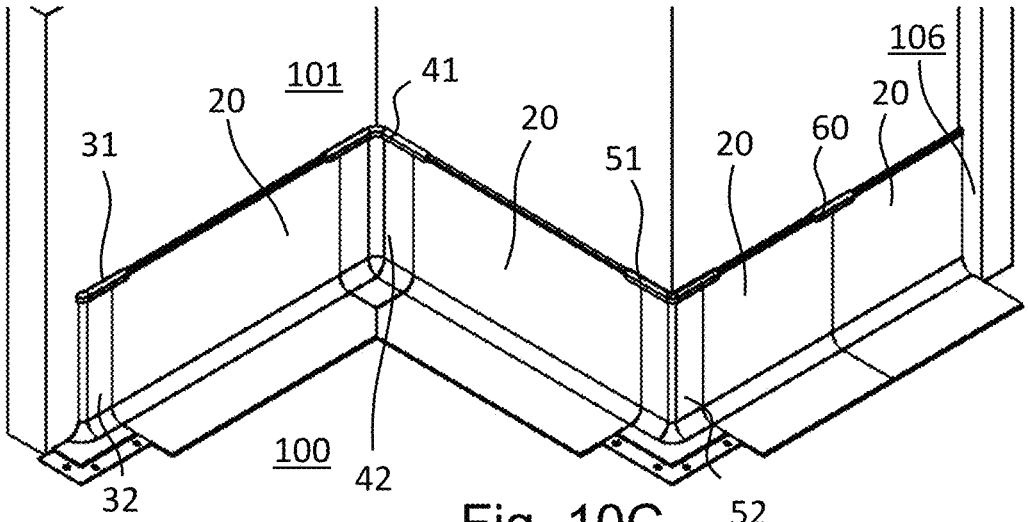

FIGS. 10A-10C show the steps of mounting the combination of flash coving profiles 20 and end elements 30, 40, 50, 60 on a floor line, i.e. the transition between (sub)floor 100 and wall 101.

FIG. 10A shows that the wall fixator parts 31, 41, 51 and the connection element 60 are mounted on the wall 101 at the desired height. This desired height may for example be determined by measurement, using a template or using the transition parts 32, 42, 52. The wall fixator parts 31, 41, 51 are fixed on the wall 101 with screws placed through the respective fixation holes.

FIG. 10B shows that the transition part 32, 42, 52 are arranged with their respective upper edges 35, 45, 55 in the holding spaces 34, 44, 54 of the wall fixator parts 31, 41, 51. The transition part 32, 42, 52 may be fixed in these positions by introducing screws through the fixation holes and/or by gluing or other fixation methods.

FIG. 10C shows that the flash coving profiles 20 are mounted, whereby the first edge 2 of the flash coving profiles 20 at their respective first and second ends are placed in the holding spaces 34, 44, 54, 62 of the wall fixator parts 31, 41, 51 and the connection element 60. The flash coving profiles may be adhered to the (sub)floor 100 and/or wall 101, for example using glue. Most of the fixation holes 39, 49, 59, 63 are now covered by the transition parts 32, 42, 52 and the flash coving profiles 20. The fixation holes that are still exposed will be covered by further flooring that will be arranged on the (sub)floor 100. The further flooring may be welded to the flooring of the flash coving profiles 20 using suitable welding techniques, such as fusing or melting a thermoformable rod in the seam between two sheets.

The resulting floor covering now has, also due to the end elements 30, 40, 50 and the connection element 60, a neat transition at the floor line between the (sub)floor 100 and the wall 101. At the same time pulling the floor covering off the floor has been made more difficult by the provision of the end elements.

What is claimed:

1. A method for arranging a flash coving profile in the transition between a floor and a wall, comprising the steps of:

providing a flash coving profile, the flash coving profile comprising: an elongate metal sheet with a first longitudinal edge and a second edge opposing the first longitudinal edge, wherein the first longitudinal edge and the second edge of the elongate metal sheet extend from a first end to a second end of the elongate metal sheet; a flexible flooring adhered to a first face of the elongate metal sheet, the flexible flooring extending from the first longitudinal edge to at least the second edge and from the first end to the second end; and a cove bent into the elongate metal sheet with the flexible flooring adhered to it along a bend line which is parallel to and spaced apart from the first longitudinal edge and on a side to which the flexible flooring is adhered, the flash coving profile having a first section extending between the first longitudinal edge and the cove and a second section extending between the second edge and the cove;

adhering the first section of the flash coving profile to the wall;

adhering the second section of the flash coving profile to the floor; and providing a further flexible flooring to the floor abutting the flexible flooring of the flash coving profile, providing an end element, the end element comprising a transition part having an outer surface, an upper edge and a first side, the first side to be placed against the first end of the elongate metal sheet, and a wall fixator part, wherein the wall fixator part comprises a holding space to hold the upper edge of the transition part and the first longitudinal edge of the elongate metal sheet at the first end, fixing the wall fixator part to the wall, placing the upper edge of the transition part in the holding space of the wall fixator part and fixing the transition part to the floor and/or the wall, and placing the first longitudinal edge of the flash coving profile at its the first end in the holding space such that the first side of the transition part is placed against the first end of the elongate metal sheet.

2. The method of claim 1, wherein, when the first longitudinal edge of the flash coving profile at the first end is placed in the holding space, the outer surface of the transition part lies substantially flush with the flexible flooring of the flash coving profile.

3. The method of claim 1, wherein the steps of fixing the wall fixator part to the wall and fixing the transition part to the floor and/or the wall are carried out before adhering the first section of the flash coving profile to the wall and the second section of the flash coving profile to the floor.

4. The method of claim 1, wherein the end element is a left end cap element, a right end cap element, an inner corner element or an outer corner element.

5. The method of claim 1, wherein the wall fixator part is made of metal and the transition part is made of a polymer material or a resin material.

6. The method of claim 1, wherein the wall fixator part comprises one or more fixation holes wherein fixing the wall fixator part to the wall comprises screwing or gluing using the one or more fixation holes and wherein the transition part comprises one or more fixation holes, wherein fixing the transition part to the floor and/or the wall comprises screwing or gluing using the one or more fixation holes.

7. The method of claim 6, comprising the step of covering the fixation holes of the wall fixator part by the flash coving profile, transition part and/or further flooring and the step of covering the fixation holes of the transition part by the flash coving profile and/or further flooring.

8. The method of claim 1, wherein the method further comprises:

providing a second end element, the second end element comprising a transition part having an outer surface, an upper edge and a first side, the first side to be placed against the second end of the elongate metal sheet, and a wall fixator part, wherein the wall fixator part comprises a holding space to hold the upper edge of the transition part and the first longitudinal edge of the elongate metal sheet at the second end, fixing the wall fixator part of the second end element to the wall, placing the upper edge of the transition part of the second end element in the holding space of the wall fixator part and fixing the transition part to the floor and/or the wall, and placing the first longitudinal edge of the flash coving profile at the second end in the holding space such that the first side of the transition part is placed against the second end of the elongate metal sheet, and wherein the outer surface of the transition part lies substantially flush with the flexible flooring of the flash coving profile.

9. The method of claim 1, further comprising the step of welding the flexible flooring of the flash coving profile to the further flooring.

10. A combination of a flash coving profile and an end element, the flash coving profile comprising:

an elongate metal sheet with a first longitudinal edge and a second edge opposing the first longitudinal edge, wherein the first longitudinal edge and the second edge of the elongate metal sheet extend from a first end to a second end of the elongate metal sheet;

a flexible flooring adhered to a first face of the elongate metal sheet, the flexible flooring extending from the first longitudinal edge to at least the second edge and from the first end to the second end; and a cove bent into the elongate metal sheet with the flexible flooring adhered to it along a bend line which is parallel to and spaced apart from the first longitudinal edge and on a side to which the flexible flooring is adhered, and the end element comprising:

a transition part having an outer surface, an upper edge and a first side, the first side to be placed against the first end or the second end of the elongate metal sheet, and a wall fixator part to be fixated to a wall, wherein the wall fixator part comprises a holding space to hold the upper edge of the transition part and the first longitudinal edge of the elongate metal sheet at the first end of the elongate metal sheet.

11. The combination of claim 10, wherein, when the first side is placed against the first end or the second end of the elongate metal sheet, the outer surface of the transition part lies substantially flush with the flexible flooring of the flash coving profile.

12. The combination of claim 10, wherein the end element is a left end cap element, a right end cap element, an inner corner element or an outer corner element.

13. The combination of claim 10, wherein the wall fixator part is made of metal and the transition part is made of a polymer material or a resin material.

14. The combination of claim 10, wherein the wall fixator part comprises one or more fixation holes to fix the wall fixator part to a wall.

15. The combination of wherein 10, wherein the transition part comprises one or more fixation holes to fix the transition part to a floor and/or a wall.

16. The combination of claim 10, wherein the transition part of the end element comprises a second side, the second side to be placed against the second end of a elongate metal sheet of a second flash coving profile, wherein the holding space is arranged to hold the upper edge of the transition part, the first longitudinal edge of the elongate metal sheet of the first flash coving profile at the first end of the first flash coving profile and the first longitudinal edge of the elongate metal sheet of the second flash coving profile at the second end.

17. The combination of claim 10, wherein the combination comprises a second end element, the second end element comprising:

a transition part having an outer surface, an upper edge and a first side, the first side to be placed against the first end or the second end of the elongate metal sheet, and a wall fixator part to be fixated to a wall, wherein the wall fixator part comprises a holding space to hold the upper edge of the transition part and the first longitudinal edge of the elongate metal sheet at the second end.

* * * * *